US009637982B2

(12) United States Patent
Jansson et al.

(10) Patent No.: US 9,637,982 B2
(45) Date of Patent: May 2, 2017

(54) SHOCK WAVE MODIFICATION IN PERCUSSION DRILLING APPARATUS AND METHOD

(71) Applicant: SANDVIK INTELLECTUAL PROPERTY AB, Sandviken (SE)

(72) Inventors: Tomas Sh Jansson, Gavle (SE); Andreas Rindeskar, Hofors (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/917,284

(22) PCT Filed: Aug. 27, 2014

(86) PCT No.: PCT/EP2014/068126

§ 371 (c)(1),
(2) Date: Mar. 8, 2016

(87) PCT Pub. No.: WO2015/032661

PCT Pub. Date: Mar. 12, 2015

(65) Prior Publication Data

US 2016/0215573 A1 Jul. 28, 2016

(30) Foreign Application Priority Data

Sep. 9, 2013 (EP) ..... 13183520

(51) Int. Cl.

| | |
|---|---|
| ***E21B 17/042*** | (2006.01) |
| ***E21B 1/00*** | (2006.01) |
| ***E21B 1/02*** | (2006.01) |

(52) U.S. Cl.
CPC ..... *E21B 17/0426* (2013.01); *E21B 1/00* (2013.01); *E21B 1/02* (2013.01)

(58) Field of Classification Search
CPC ..... E21B 1/00
See application file for complete search history.

(56) References Cited

U.S. PATENT DOCUMENTS

| | | | | |
|---|---|---|---|---|
| 2,762,132 | A * | 9/1956 | Varney | E21B 47/011 33/307 |
| 6,021,855 | A | 2/2000 | Beccu et al. | |
| 7,886,843 | B2 * | 2/2011 | Weddfelt | B25D 17/245 175/24 |
| 8,061,434 | B2 | 11/2011 | Keskiniva et al. | |
| 2009/0065224 | A1 * | 3/2009 | Noel | E21B 17/00 173/1 |
| 2009/0308627 | A1 | 12/2009 | Andersson | |
| 2010/0108381 | A1 | 5/2010 | Sinnerstad et al. | |

(Continued)

FOREIGN PATENT DOCUMENTS

| | | | |
|---|---|---|---|
| GB | 659331 | A | 10/1951 |
| SE | 432280 | B | 3/1984 |

(Continued)

*Primary Examiner* — Shane Bomar
(74) *Attorney, Agent, or Firm* — Corinne R. Gorski

(57) ABSTRACT

A percussion drilling apparatus is arranged to affect at least one characteristic of a shock wave produced in a drill string. The apparatus includes an elongate energy transmission adaptor having a shock wave modification sleeve configured with a free end and an attachment end projecting radially from an outer surface of the adaptor.

14 Claims, 6 Drawing Sheets

(56) References Cited

U.S. PATENT DOCUMENTS

| | | | | |
|---|---|---|---|---|
| 2010/0258326 | A1 | 10/2010 | Weddfelt | |
| 2016/0069135 | A1* | 3/2016 | Puttmann | E21B 1/00 175/296 |
| 2016/0130938 | A1* | 5/2016 | Koll | E21B 49/003 367/27 |

FOREIGN PATENT DOCUMENTS

| | | | |
|---|---|---|---|
| WO | 9708421 | A1 | 3/1997 |
| WO | 2008041906 | A1 | 4/2008 |
| WO | 2008127173 | A1 | 4/2008 |

* cited by examiner

SHOCK WAVE MODIFICATION IN PERCUSSION DRILLING APPARATUS AND METHOD

RELATED APPLICATION DATA

This application is a §371 National Stage Application of PCT International Application No. PCT/EP2014/068126 filed Aug. 27, 2014 claiming priority of EP Application No. 13183520.9, filed Sep. 9, 2013.

FIELD OF INVENTION

The present invention relates to percussion drilling apparatus and a method in which at least one characteristic of a shock wave produced in the drill string is modified to optimise drilling performance.

BACKGROUND ART

Percussion drilling is a well-established technique that breaks rock by hammering impacts transferred from the rock drill bit, mounted at one end of a drill string, to the rock at the bottom of the borehole. The energy needed to break the rock is generated by a hydraulically driven piston that contacts a shank adaptor positioned at the opposite end of the drill string to the drill tool. The piston strike on the adaptor creates a stress (or shock) wave that propagates through the drill string and ultimately to the borehole rock bottom. To achieve maximum drilling efficiency, various physical parameters associated with the piston, the shank adaptor and drill rods of the drill string must be optimised.

In particular, the shock wave created within the drill string typically comprises a rectangular shape profile. The length of the shock wave is twice the axial length of the piston whilst the amplitude is dependent on the velocity of the piston at the moment of impact and a relationship between a cross sectional area of the piston impact end and that of the drill string. The optimised energy is typically achieved by variation of these parameters including piston geometry and impact rate and frequency.

However, the energy within the shock wave typically decreases as it travels axially along the drill string and through each threaded coupling that connects the drill rods. This loss results from differences in the cross sectional area between the male and female threaded couplings involving reflections and impedance transmissions that generally change the shape of the shock wave as it propagates. Depending upon the physical characteristics of the drill string and indeed the piston and shank adaptor, the transmitted wave can be smoothened or increased in amplitude due to super positioning and reflections. Example percussion drilling systems are described in GB 659,331; SE 432280; WO 2008/041906 and U.S. Pat. No. 8,061,434. U.S. Pat. No. 8,061,434 in particular describes a method of controlling operation of the percussion piston to influence the shape of the stress wave in an attempt to increase drilling efficiency.

However, existing percussion drilling systems are not optimised to reduce as far as possible energy loses within the shock wave as it propagates along the entire length of the drill string whilst delivering an energy shock wave at the drill string tool having a shape characteristic is optimised for rock breakage. There is therefore a need for a percussion drilling system that addresses these problems.

SUMMARY OF THE INVENTION

It is an objective of the present invention to modify the incident shock wave received at each threaded coupling to minimise any changes to the shock wave shape profile that would be otherwise detrimental to the form of the energy delivered by the drill tool to the rock. It is a further objective to provide an apparatus and method that is compatible for use with existing hydraulic hammering systems (and indeed older pneumatic systems).

The objectives are achieved via a shock wave modification sleeve that is mounted at an elongate energy transmission adaptor configured to influence the wavelength and amplitude characteristics of the shock wave as it is transmitted through the modification sleeve. By configuring the sleeve with a free end suspended radially from a main length of the energy transmission adaptor, it is possible to convert the stress wave type (between compressive and tensile) and by super positioning with the incident wave the sleeve is configured to significantly change the amplitude characteristics of the transmitted shock wave to be optimised for both efficient transmission through the threaded couplings of the drill string and to maximise the impacting action against the rock at the bottom of the borehole.

Additionally, by specifically selecting a ratio of an axial length of the modification sleeve and an axial length of the hydraulically driven piston within a range 0.1 to 1.0, the energy transmission efficiency is optimised. This is achieved by selectively removing amplitude from an initial wavelength section and super positioning this removed amplitude at a later section of the wavelength. This is advantageous as typically poor contact is made between the bit and the rock over the initial time period of the wavelength and the associated initial impulse energy is wasted. The subject invention is therefore effective to maximise the use of the delivered energy at the drill bit to provide maximum energy transfer as the drill bit is provided in full contact with the rock.

The present invention is further advantageous in that the elongate energy transmission adaptor carrying the modification sleeve may be positioned axially at the ground level end of the drill string to be contacted by the hammer piston or within the drill string axially between drill string rods. Additionally, a drill string according to the subject invention may comprise a plurality of adaptors with modification sleeves distributed axially at various positions within and at the end of the drill string.

According to a first aspect of the present invention there is provided percussion drilling apparatus to affect at least one characteristic of a shock wave produced in a drill string, the apparatus comprising: an elongate piston having a main length and an energy transmission end, the piston mounted to shuttle back and forth axially to contact a drill string or an intermediate adaptor and create a shock wave within the drill string; an elongate energy transmission adaptor having a rearward end to receive energy from the piston and a forward end for coupling to the drill string, a length section positioned axially between the ends; characterised in that: the adaptor comprises an elongate shock wave modification sleeve having a free end and an attachment end formed as an annular wall that projects radially from the length section of the adaptor at an axial position between the ends such that a main length section and the free end of the sleeve are separated radially from and surround a region of an outer surface of the length section of the adaptor; and an annular gap region is positioned radially between the outer surface and the main length section; wherein a ratio of an axial length of the sleeve main length section and an axial length of the main length of the piston is in a range 0.1 to 1.0.

Optionally, the ratio may be in a range 0.2 to 0.5, 0.3 to 0.4, 0.34 to 0.4. Optionally, the ratio is substantially 0.38.

This ratio is advantageous to optimise the displacement of the energy wave amplitude within the wave form from an initial time period to a later time period within the wavelength.

Preferably, the sleeve length section is aligned coaxially with the length section of the adaptor between the rearward and forward ends. This is beneficial to maintain to a minimum the radial distance by which the sleeve extends from the adaptor to allow convenient installation of the adaptor and sleeve within the drill string assembly.

Optionally, the annular wall comprises an annular forward face positioned closest to forward end and an annular rear face positioned closest to free end relative to forward face. Positioning the sleeve within the axial length of the adaptor minimises an overall length of the adaptor and allows convenient coupling of the adaptor to one or more drill rods.

Preferably, the adaptor is mounted at a rearward end of the drill string and axially between the drill string and the piston such that the energy transmission end of the piston is configured to strike directly the rearward end of the adaptor. Optionally, the adaptor is mounted axially within the drill string between a rearward end of the drill string and a drill tool mounted at a forward end of the drill string.

Where the adaptor is configured for mounting within the drill string between the string rearward end and drill tool, the adaptor preferably takes the form of a drill rod in which the shock wave modification sleeve is mounted internally within the main tubular body of the rod between the forward and rearward ends. Drill rods typically comprise hollow internal chamber (as defined by the tubular walls of the rod) of sufficient internal cross sectional area to accommodate the present modification sleeve. As will be appreciated, the sleeve may be orientated to project forwardly or rearwardly within the body of the rod (with respect to the orientation of the sleeve free end relative to the ends of the rod). Such a configuration is advantageous to allow the rod to be advanced and retracted within the borehole without the sleeve interfering and inhibiting this axial movement. The present energy transmission adaptor may therefore be considered to be a modified form of drill rod.

Optionally, a ratio between a cross sectional area of the sleeve and the energy transmission end of the piston in a plane perpendicular to a longitudinal axis of the piston and adaptor is in a range 0.3 to 1.5. Optionally, the ratio of the cross sectional area is in a range 0.7 to 1.3.

Optionally, the free end of the sleeve is positioned axially closer to the piston than the attachment end. Optionally, the attachment end of the sleeve is positioned axially closer to the piston than the free end.

Optionally, a wall thickness of the sleeve between the free end and the attachment end is substantially uniform. Optionally, a wall thickness of the sleeve may taper so as to increase or decrease in thickness from the attachment end to the free end. The rate of change in wall thickness of the sleeve may be uniform along the length of the sleeve or may be variable to create sections of the sleeve with different wall thickness to change the characteristics of the transmitted shock wave. Optionally, the sleeve may comprise a conical configuration in which both the radially inner and outer surfaces of the sleeve are tapered relative to the longitudinal axis so as to decrease or increase the wall thickness of the sleeve between the free and attachment ends.

Optionally, the adaptor comprises at least one male or female threaded end configured for coupling to a corresponding and respective female or male end of a drill rod forming part of the drill string.

According to a second aspect of the present invention there is provided a method of percussion drilling to affect at least one characteristic of a shock wave produced in a drill string, the method comprising: creating a shock wave within a drill string by axially advancing an elongate piston having a main length and an energy transmission end to contact the drill string or an intermediate adaptor; transmitting the shock wave from the piston through an elongate energy transmission adaptor having a rearward end, a forward end and a length section positioned axially between the ends; characterised by: modifying at least one characteristic of the shock wave via an elongate shock wave modification sleeve having a free end and an attachment end formed as an annular wall that projects radially from the length section of the adaptor at an axial position between the ends such that a main length section and the free end of the sleeve are separated radially from and surround a region of an outer surface of the length section of the adaptor; an annular gap region positioned radially between the outer surface and the main length section; wherein a ratio of an axial length of the sleeve main length section and an axial length of the main length of the piston is in a range 0.1 to 1.0.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
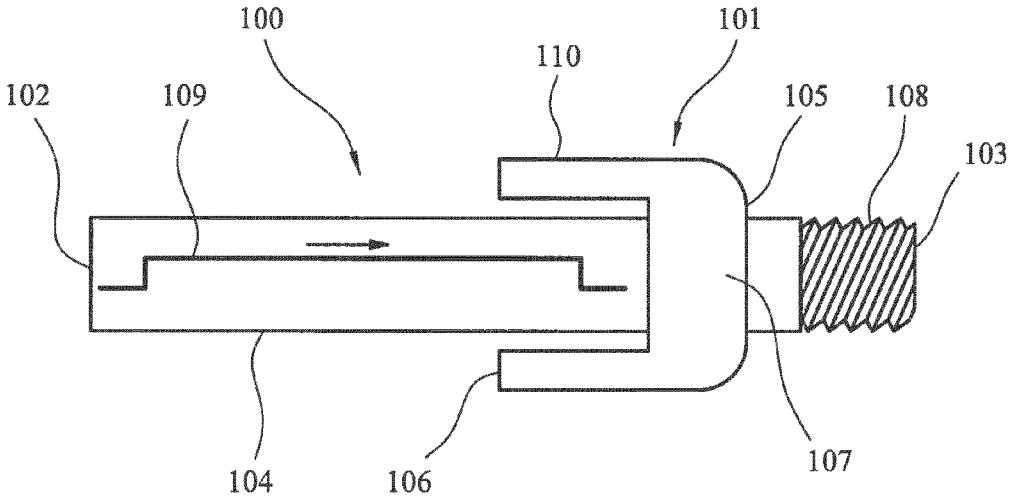
FIG. 1 illustrates schematically the main components of an elongate energy transmission adaptor and shock wave modification sleeve according to a specific implementation of the present invention.

Referring to FIG. 1, an elongate energy transmission adaptor 100 comprises a main length section 104 having a rearward end 102 and a forward end 103. A shock wave modification sleeve 101 projects radially from the main length section 104 and extends axially along the region of section 104 axially between adaptor ends 102, 103. In particular, sleeve 101 comprises an attachment end 105 that is connected to a region of adaptor main length section 104 and an annular free end 106 that is suspended radially from and encircles adaptor main length section 104. Sleeve 101 comprises a main length section 110 extending axially between ends 105, 106. Attachment end 105 is formed as an annular radially extending wall 107 that projects from adaptor length section 104 at an axial region closer to forward end 103 than rearward end 102. To enable adaptor 100 to be coupled to a drill string, forward end 103 comprises a threaded end section 108 configured as a male spigot for coupling and housing within a corresponding threaded female coupling.

Figure 2:
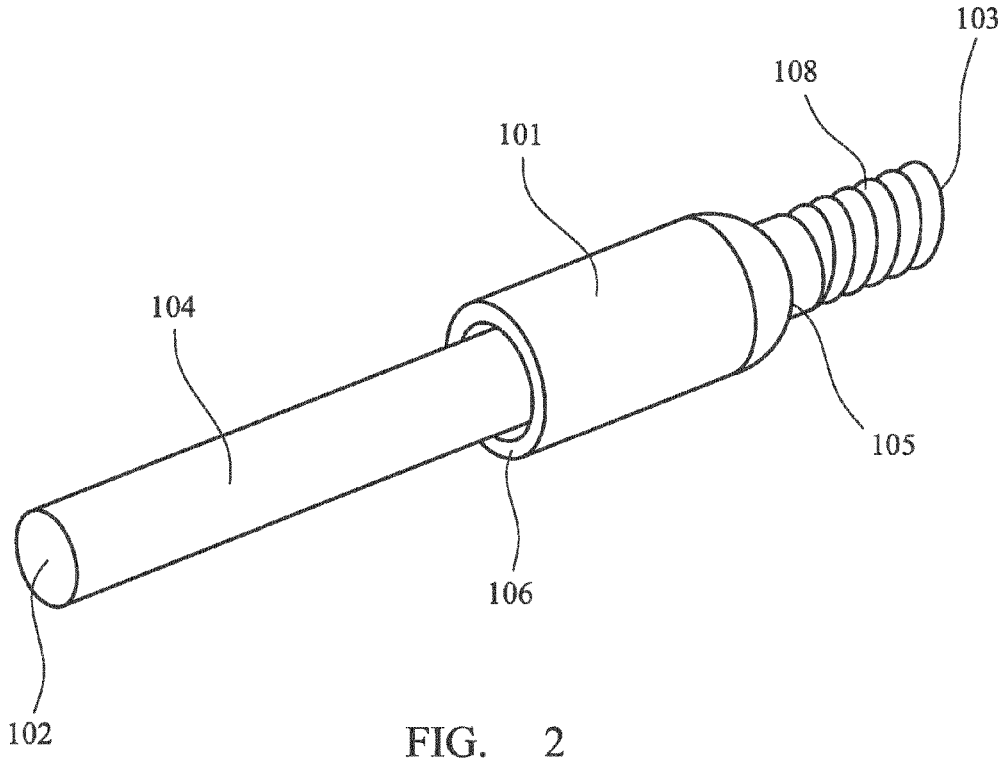
FIG. 2 illustrates schematically an external perspective view of the device of FIG. 1.
Figure 3:
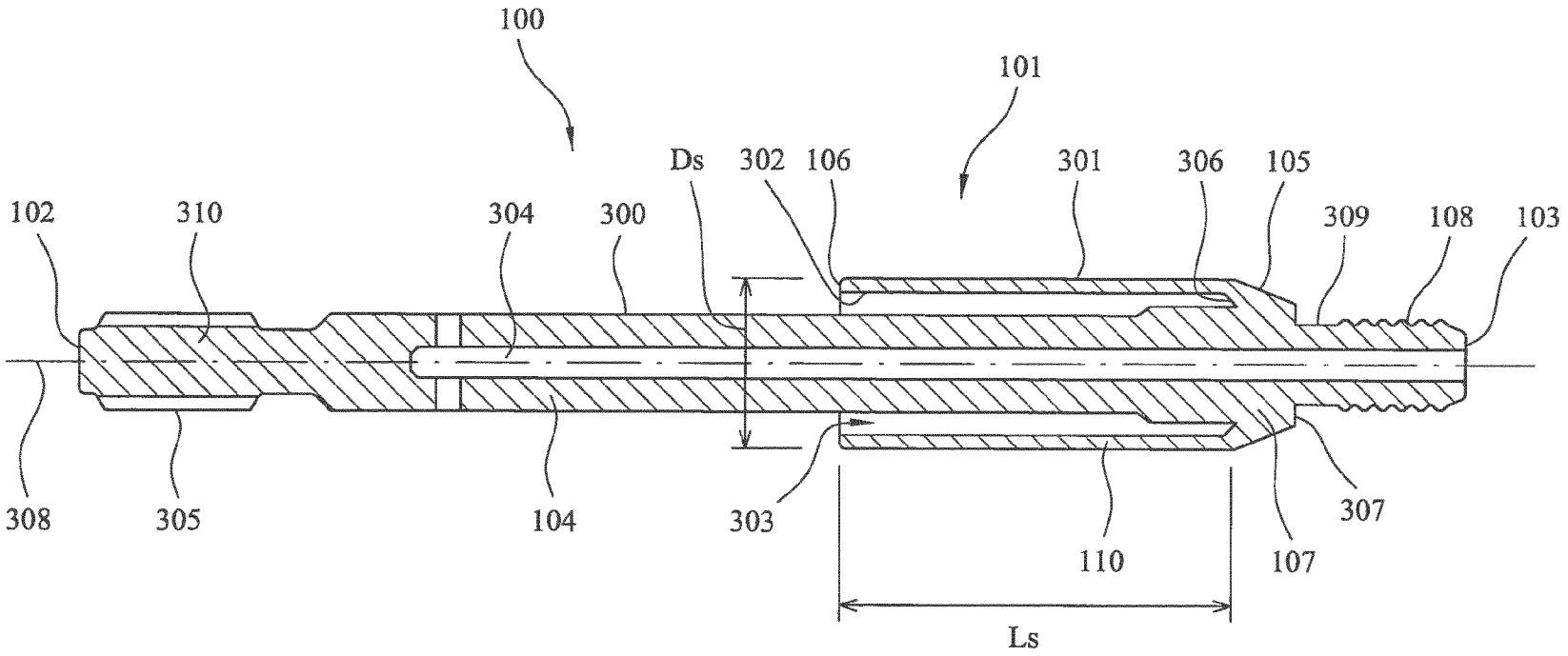
FIG. 3 illustrates a cross sectional view of the device of FIG. 2.

Referring to FIGS. 2 and 3, sleeve 101 comprises a generally tubular configuration having an external surface 301 and an internal surface 302 that define a substantially cylindrical wall extending between the attachment end 105 and free end 106. According to the specific implementation, a wall thickness between surfaces 301 and 302 is substantially uniform along the sleeve main length section 110. According to the specific embodiment of FIG. 3, sleeve main length 110 is aligned substantially parallel to a longitudinal axis 308 that extends through the elongate adaptor 100.

Attachment end 105 is formed as an annular radially extending flange or wall 107 that comprises an annular forward face 307 positioned closest to forward end 103 and an annular rear face 306 positioned closest to free end 106 relative to face 307. An axial length of wall 107 between faces 306, 307 is significantly less than an axial length of sleeve length section 110 that is defined and extends axially between face 306 and free end 106. The sleeve length section 110 is mounted at annular wall 107 so as to provide a clearance gap 303 between the inward facing surface 302 of sleeve 101 and an outward facing surface 300 of the adaptor length section 104. According, the annular free end 106 and the cylindrical sleeve length section 110 are separated radially from adaptor outward surface 300 by annular gap 303.

The threaded section 108 at forward end 103 is axially separated from wall surface 307 by an axially extending shank portion 309 that is devoid of helical threads. According to the specific implementation free end 106 is orientated towards adaptor rear end 102 such that attachment end 105 is positioned closest to adaptor forward end 103 than sleeve free end 106. Adaptor rearward end 103 comprises an axially rearward section 310 comprising a plurality of parallel axially extending splines 305 configured to be engaged by corresponding splines of a rotation motor to induce rotation of the adaptor 100 about axis 308. Adaptor 100 further comprises an internal bore 304 extending substantially the majority of adaptor length section 104 to allow flushing fluids to pass through adaptor 100 for delivery through the drill string to flush cuttings and fines from the drill hole as will be appreciated.

Figure 4:
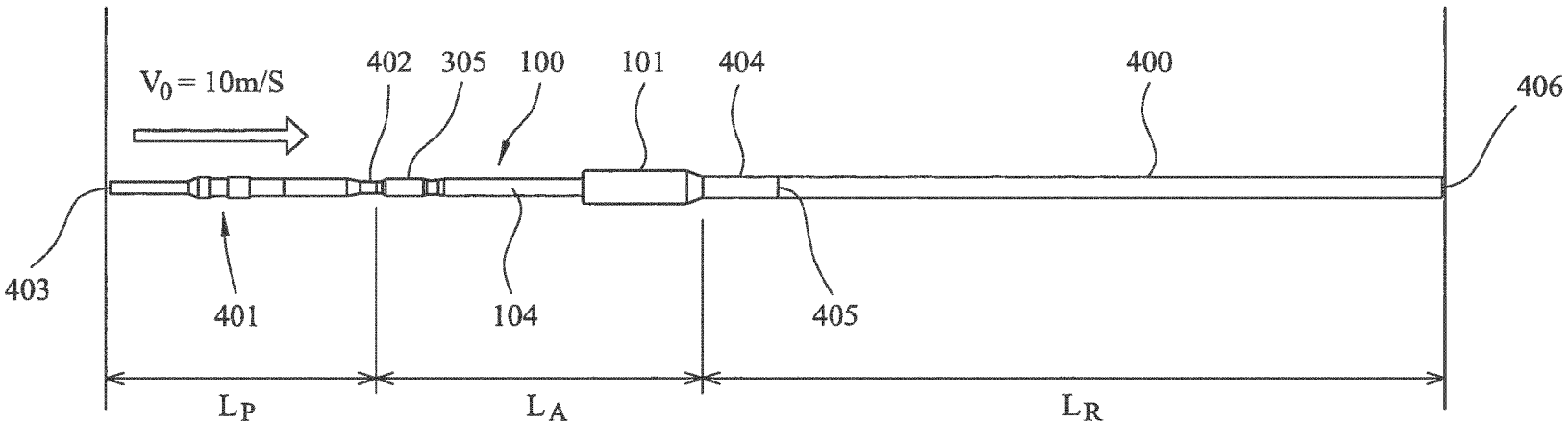
FIG. 4 illustrates the device of FIG. 3 mounted in position between an elongate piston and one end of a drill string according to a specific implementation of the present invention.

Referring to FIGS. 3 and 4, an axial length $L_S$ of sleeve length section 110 is configured specifically to correlate with an axial length $L_P$ of a hydraulically driven elongate piston 401 having an energy transmission end 402 and a rear end 403. In particular, a ratio of $L_S$ and $L_P$ is in a range 0.1 to 1 and is specifically in a range 0.3 to 0.4. According to the specific implementation, this ratio is 0.38. As illustrated in FIG. 4, adaptor 100 is positioned axially between piston 401 and a rearwardmost drill rod 400 of an elongate drill string, where rod 400 comprises a forward end 406 and rearward end 405. The threaded end section 108 of adaptor 100 is mated with a female threaded coupling at rearward rod end 405 to form a threaded coupling joint 404. The length of the rod is denominated $L_R$.

According to the specific implementation, a ratio of the cross sectional area of sleeve 101 in a plane corresponding to the diameter $D_S$ of the sleeve external surface 301 and a cross sectional area of the energy transmission end 402 of piston 401 (in the same plane perpendicular to axis 308) is in a range 0.5 to 1.5 and preferably 0.7 to 1.3 with the optimal configuration being approximately 1.0. Such a configuration is effective to minimise impedance mismatch and accordingly maximise the energy transmission efficiency of the assembly of FIG. 4.

The adaptor 100 and in particular sleeve 101 is configured specifically to affect the amplitude characteristic of the shock wave as it is transmitted through adaptor 100 from piston 401 to the drill rods 400. In particular, as piston 401 is actuated to advance axially at an initial velocity of 10 m/s to impact adaptor rearward end 102 the incident shock wave 109 comprises a generally a rectangular shape profile (when piston 401 is hydraulically powered) having a wavelength that is twice $L_P$. Stress wave 109 propagates through adaptor main length section 104 and into sleeve 101 via wall 107. Sleeve 101 is effective to translate the compressive wave 109 propagating in adaptor length 104 (from left to right) into a tensile wave within wall 107. This wave then travels in the reverse direction along the sleeve main length 110 towards free end 106 where it is reflected as a compressive wave. Due to super positioning, this newly generated compressive wave is added to the incident wave 109. This is achieved as the axial length $L_S$ is less than half of the wavelength of the incident wave 109. By specifically selecting a relationship between $L_S$ and $L_P$, the present invention provides a device configured to selectively manipulate a shock wave shape for optimised drill bit-rock interaction.

Figure 5:
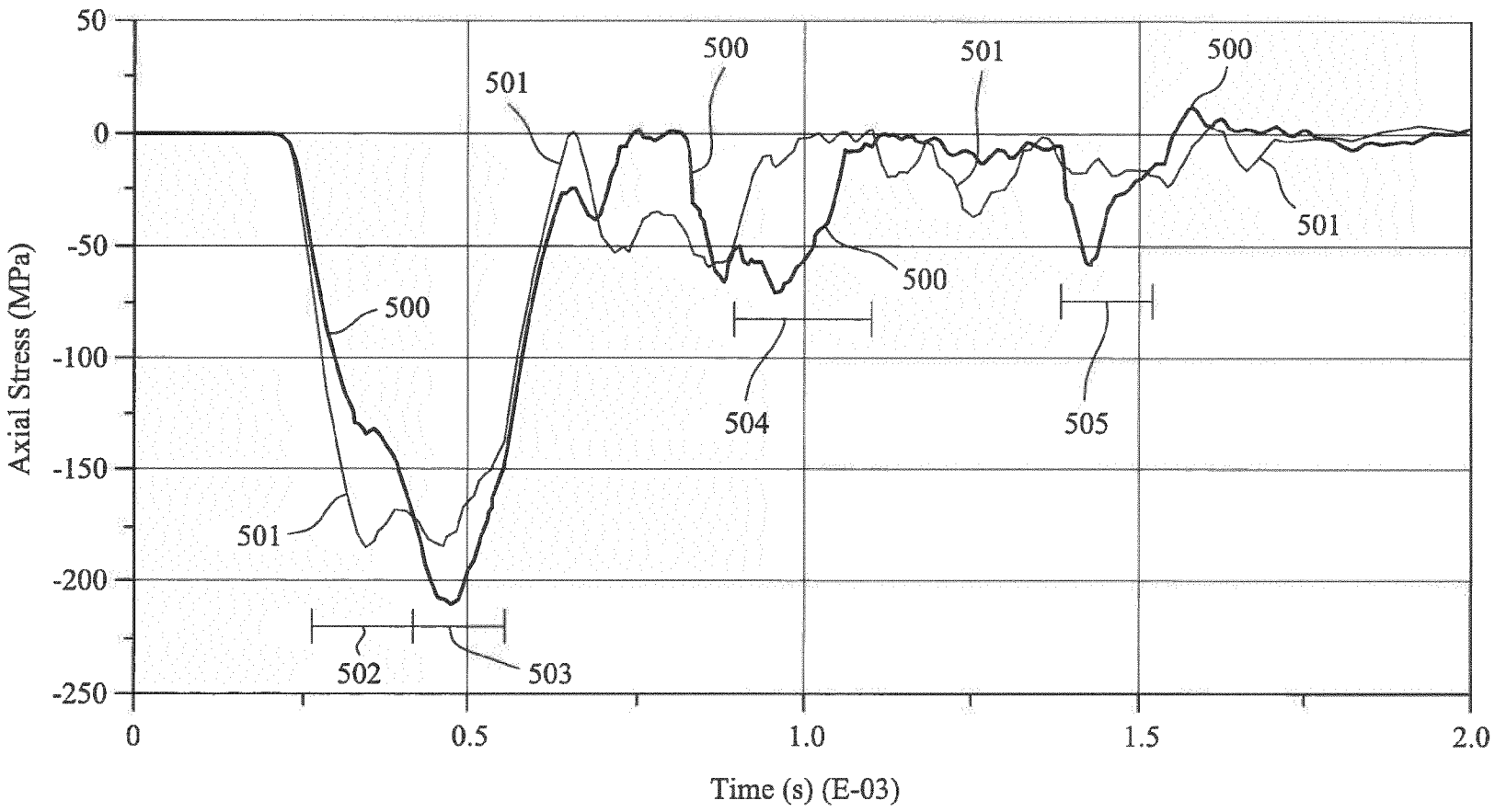
FIG. 5 is a graph detailing the shape profile of a shock wave both incident at and transmitted through the shock wave modification sleeve within the configuration of FIG. 4 according to a specific implementation of the present invention.

This is illustrated in FIG. 5 which shows the propagating shock wave at a position within drill rod 400 after transmission through the modification sleeve 101. The shock wave created using the apparatus of FIG. 4 is represented by 500 whilst 501 corresponds to the analogous arrangement of FIG. 4 but without a modification sleeve 101 provided at adaptor 100. As will be noted, the effect of sleeve 101 is to remove the initial energy segment 502 and to super position this onto a later segment of the wave 503. Corresponding and selective super positioning and displacement is indicated generally by 504 and 505.

As will be noted, the unmodified wave 501 comprises a generally rectangular pulse profile that is modified to the more angular shape profile within segment 503 having increased amplitude for maximised impact performance of the drill bit at the rock. The present configuration is also advantageous to provide less rock reflections and to minimise problems associated with temperature increase within male and female threaded couplings between drill rods 400. Additionally, the energy transmission efficiency of the shock wave may be modified and optimised by configuration of $L_S$ and in particular the axial separation distance of the free end 106 and attachment end 105.

The simulated data of FIG. 5 was generated using LS-DYNA smp R4.2.1 rev. 53450 in single precision to make the simulations compiled for Linux CentOS 5.3. The computational problem was solved on 11 Xenon64 CPUs and contained 1131734 4-noded tetrahedral elements and 253242 nodes. Additionally, the relative dimensions of the modelled drill string apparatus were $L_S$=200 mm; $L_P$=790 mm; $L_A$=935; $L_R$=2700 mm; and $D_S$=132 mm. The wall thickness of adaptor sleeve main length 110 was 10 mm; the diameter of the adaptor main length section 104 was 78 mm; and the internal diameter of flushing bore 304 was 25 mm.

Figure 6:
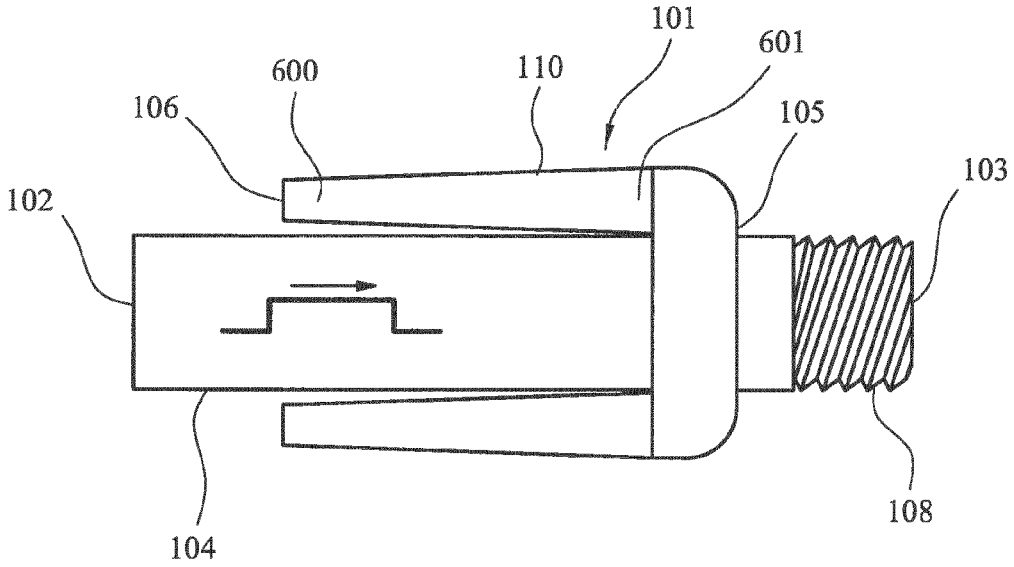
FIG. 6 illustrates schematically the main components of an elongate energy transmission adaptor and shock wave modification sleeve according to a further specific implementation of the present invention in which the walls of the sleeve comprise a tapered thickness.
Figure 7:
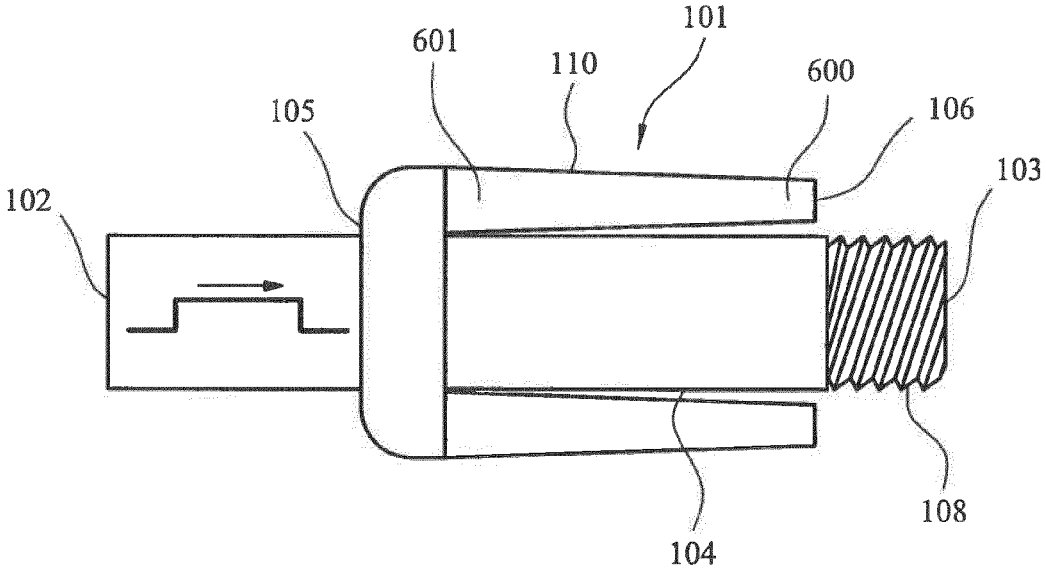
FIG. 7 illustrates schematically the main components of an elongate energy transmission adaptor and shock wave modification sleeve in which the sleeve is orientated in the opposite direction to the embodiment of FIG. 6.

FIGS. 6 and 7 illustrate further specific embodiments of the subject invention. Referring to FIG. 6, the sleeve 101 comprises a main length section 110 having a wall thickness that decreases from attachment end 105 to free end 106. That is, a thickness of length section 110 at region 601 is greater than a corresponding wall thickness at region 600. This axial taper of the wall thickness from end 105 to end 106 is provided as the radially inner and outer surfaces 301, 302 of length section 110 are aligned transvers to longitudinal axis 308 (with reference to FIG. 3). A variation in the sleeve wall thickness is advantageous to allow further adjustment of the characteristics of the transmitted shock wave as desired.

Referring to FIG. 7, the sleeve 101 may comprise a different orientation such that the free end 106 is orientated towards forward end 103 whilst attachment end 105 is orientated towards rearward end 102. Such an embodiment (having a sleeve wall configuration of the type of FIG. 1, 6 or other variant) is configured to convert a compressive wave travelling from left to right (of FIG. 7) within sleeve 101 to a tensile wave travelling in the opposite direction due to reflection at free end 106. The tensile wave is then super positioned as a compressive wave to provide the same modifications to the shock wave as the previous embodiment of FIG. 6.

Figure 8:
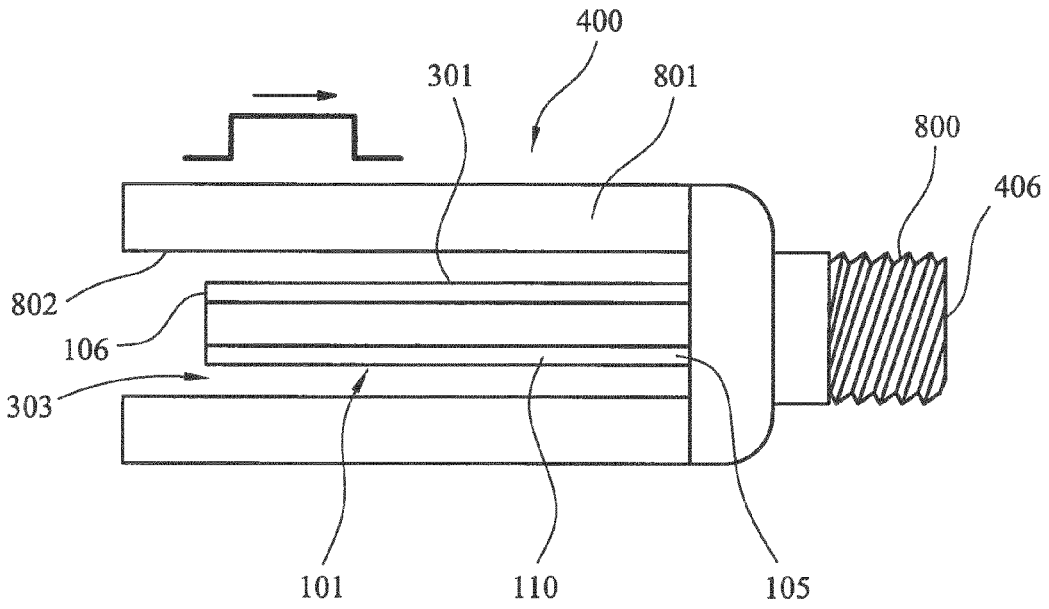
FIG. 8 illustrates schematically the main components of an elongate energy transmission adaptor and shock wave modification sleeve with the sleeve positioned internally within the body of the energy transmission adaptor.

FIG. 8 illustrates schematically a further embodiment in which sleeve 101 is positioned internally within the elongate hollow body of drill rod 400 to provide a modified energy transmission adaptor rod that may be conveniently installed within a drill string between a rearward end and a tool end. According to the specific embodiment, the modified drill rod 400 comprises a substantially cylindrical wall 801. Sleeve 101 is positioned internally within rod 400 to be surrounded by wall 801. Accordingly, sleeve outer surface 301 is positioned opposed to a radially inward facing surface 802 of rod wall 801. A corresponding gap region 303 is therefore provided axially along the sleeve length section 110 between attachment end 105 and free end 106. As will be appreciated, the embodiment of FIG. 8 may be implemented according to the previous embodiments of FIGS. 6 and 7 with the free end 106 orientated towards a forward end of the rod (consistent with FIG. 7) and a rearward end of the rod (consistent with FIG. 6).

The invention claimed is:

1. A percussion drilling apparatus arranged to affect at least one characteristic of a shock wave produced in a drill string, the apparatus comprising:

an elongate piston having a main length and an energy transmission end, the piston being mounted to shuttle back and forth axially to create a shock wave within the drill string;

an elongate energy transmission adaptor having a rearward end in contact with the energy transmission end to receive energy from the piston, a forward end for coupling to the drill string, and a length section positioned axially between the ends, wherein the adaptor includes an elongate shock wave modification sleeve having a free end and an attachment end formed as an annular wall that projects radially from the length section of the adaptor at an axial position between the ends such that a main length section and the free end of the sleeve are separated radially from and surround a region of an outer surface of the length section of the adaptor; and an annular gap region positioned radially between the outer surface and the main length section, wherein a ratio of an axial length of the sleeve main length section and an axial length of the main length of the piston is in a range 0.1 to 1.0.

2. The apparatus claimed in claim 1, wherein the ratio is in a range of 0.2 to 0.5.

3. The apparatus as claimed in claim 1, wherein the ratio is in a range of 0.3 to 0.4.

4. The apparatus as claimed in claim 1, wherein the ratio is in a range of 0.34 to 0.4.

5. The apparatus as claimed in claim 1, wherein the sleeve length section is aligned coaxially with the length section of the adaptor between the rearward and forward ends.

6. The apparatus as claimed in claim 1, wherein the annular wall includes an annular forward face positioned closest to the forward end and an annular rear face positioned closest to free end relative to the forward face.

7. The apparatus as claimed in claim 1, wherein the adaptor is mounted at a rearward end of the drill string and axially between the drill string and the piston such that the energy transmission end of the piston is configured to strike directly the rearward end the adaptor.

8. The apparatus as claimed in claim 1, wherein the adaptor is mounted axially within the drill string between a rearward end of the drill string and a drill tool mounted at a forward end of the drill string.

9. The apparatus as claimed in claim 1, wherein a ratio between a cross sectional area of the sleeve and the energy transmission end of the piston in a plane perpendicular to a longitudinal axis of the piston and adaptor is in a range 0.3 to 1.5.

10. The apparatus as claimed in claim 9, wherein the ratio of the cross sectional area is in a range of 0.7 to 1.3.

11. The apparatus as claimed in claim 1, wherein the free end of the sleeve is positioned axially closer to the piston than the attachment end.

12. The apparatus as claimed in claim 1, wherein the attachment end of the sleeve is positioned axially closer to the piston than the free end.

13. The apparatus as claimed in claim 1, wherein the adaptor includes at least one male or female threaded end configured for coupling to a corresponding and respective female or male end of a drill rod forming part of the drill string.

14. A method of percussion drilling to affect at least one characteristic of a shock wave produced in a drill string, the method comprising:

creating a shock wave within a drill string by axially advancing an elongate piston having a main length and an energy transmission end, the energy transmission end contacting an intermediate adaptor;

transmitting the shock wave from the piston through the adaptor, the adaptor being an elongate energy transmission adaptor having a rearward end, a forward end and a length section positioned axially between the ends;

modifying at least one characteristic of the shock wave via an elongate shock wave modification sleeve having a free end and an attachment end formed as an annular wall that projects radially from the length section of the adaptor at an axial position between the rearward and forward ends such that a main length section and the free end of the sleeve are separated radially from and surround a region of an outer surface of the length section of the adaptor; and an annular gap region positioned radially between the outer surface and the main length section, wherein a ratio of an axial length of the sleeve main length section and an axial length of the main length of the piston is in a range of 0.1 to 1.0.

* * * * *